United States Patent [19]

Robinette et al.

[11] Patent Number: 5,066,557

[45] Date of Patent: Nov. 19, 1991

[54] STYRENE BUTADIENE COPOLYMERS AS BINDERS IN MIXED PIGMENT GENERATING LAYER

[75] Inventors: Susan Robinette, Pittsford; Anita P. Lynch, Webster; Thomas R. Hoffend, Webster; Edward F. Grabowski, Webster; Kathleen M. Carmichael, Williamson, all of N.Y.

[73] Assignee: Xerox Corporation, Stamford, Conn.

[21] Appl. No.: 459,339

[22] Filed: Dec. 29, 1989

[51] Int. Cl.[5] ..... G03G 5/09

[52] U.S. Cl. ..... 430/58; 430/95; 430/96

[58] Field of Search ..... 430/84, 85, 69, 58, 430/95, 96

[56] References Cited

U.S. PATENT DOCUMENTS

| | | | |
|---|---|---|---|
| 3,816,118 | 6/1974 | Bryne | 96/1.5 |
| 3,879,199 | 4/1975 | Trubisky | 96/1.5 |
| 3,899,329 | 8/1975 | Bean et al. | 430/84 |
| 3,948,657 | 4/1976 | Yoshikawa et al. | 96/1.5 |
| 4,265,990 | 5/1981 | Stolka et al. | 430/59 |
| 4,340,658 | 7/1982 | Inoue et al. | 430/58 |
| 4,439,507 | 3/1984 | Pan et al. | 430/59 |
| 4,464,450 | 8/1984 | Teuscher | 430/59 |
| 4,701,396 | 10/1987 | Hung et al. | 430/58 |
| 4,786,570 | 11/1988 | Yu et al. | 430/58 |

*Primary Examiner*—John Goodrow

*Attorney, Agent, or Firm*—Oliff & Berridge

[57] ABSTRACT

A charge generating layer for an electrophotographic imaging member is provided containing trigonal selenium and phthalocyanine photoconductive particles dispersed in a film forming polymer binder. The film forming polymer binder may be a styrene butadiene copolymer having a weight percent styrene to butadiene content of about 85:15 to about 95:5 and a glass transition temperature range of about 50° C. to about 60° C. A process for producing the homogeneous dispersion of photoconductive particles includes separately milling the trigonal selenium particles and the phthalocyanine particles to approprite particle sizes, and dispersing the separately milled particles in the film forming polymer binder.

20 Claims, 1 Drawing Sheet

STYRENE BUTADIENE COPOLYMERS AS BINDERS IN MIXED PIGMENT GENERATING LAYER

BACKGROUND OF THE INVENTION

This invention relates in general to electrostatography, and more specifically, to an electrophotoconductive imaging member having an improved charge generating layer.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas. This electrostatic latent image may be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic web. The conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generating layer may comprise a homogeneous photoconductive material or particulate photoconductive material dispersed in a binder. Additional examples of binder materials such as poly(hydroxyether) resins are taught in U.S. Pat. No. 4,439,507. Photosensitive members having at least two electrically operative layers as disclosed above in, for example, U.S. Pat. No. 4,265,990, provide excellent images when charged with a uniform negative electrostatic charge, exposed to a light image and thereafter developed with finely divided electroscopic marking particles.

Photoconductive particles dispersed in a film forming binder matrix are commonly employed in charge generating layers of photosensitive members having at least two electrically operative layers. A charge generating layer containing photoconductive particles such as trigonal selenium particles dispersed in a binder matrix such as polyvinylcarbazole exhibits excellent photoresponse properties. In the form of belts having welded seams, such photoreceptors perform very well in conventional copiers and duplicators which utilize relatively large diameter photoreceptor belt drive and support rollers and gentle cleaning systems. Although trigonal selenium particles have excellent sensitivity and good response to visible light, the particles are especially difficult to disperse in polymer binders. More specifically, when photoconductive trigonal selenium particles are dispersed a film forming binder, difficulties can be encountered in achieving a uniform dispersion of the particles in the binder matrix. Nonuniform dispersion of photoconductive particles in the binder adversely affects the uniformity of electrical response over different regions of the photoreceptor.

Other photoconductive particles for charge generating layers are phthalocyanines. Phthalocyanines exhibit good response to infrared light, but, like trigonal selenium particles, are difficult to disperse in polymer binders. It would be desirable to provide a charge generating layer which has a good response to both visible and infrared light. However, it is difficult homogeneously to disperse particles having different spectral responses in a binder because of their different compatibilities with binders. Typically, a binder that will suitably disperse one type of particle fails to adequately disperse a different type of photoconductive particle which is sensitive in a different spectral region. Separate charge generating layers have been proposed comprising photoconductive particles having good response in the visible region dispersed in a binder as one generating layer, and photoconductive particles having good response in the infrared region dispersed in a binder as another generating layer.

For flexible photoreceptors, many film forming binders such as polyvinylcarbazole tend to be brittle and can crack or delaminate during extended cycling or even during cutting of photoreceptor sheets from a photoreceptor web. Small diameter drive or support rollers (e.g. 19 mm or smaller) for belt type photoreceptors are desirable for effective automatic paper strip ping. However, photoreceptor belts formed by welding overlapping opposite ends of a cut photoreceptor sheet tend to prematurely fail at the seam when cycled around these small diameter drive or support rollers, particularly in embodiments where the charge generating layer does not adhere well to adjacent layers. For example, photoreceptors containing a charge generating layer comprising trigonal selenium particles dispersed in polyvinylcarbazole usually utilize an adhesive layer to improve the adhesion of the charge generating layer to the underlying charge blocking layer or conductive layer.

The characteristics of electrostatographic imaging members comprising photoconductive particles dispersed in a binder exhibit many deficiencies in automatic, cyclic electrostatic copiers, duplicators, and printers, particularly with respect to mechanical properties.

U.S. Pat. No. 4,786,570 to Yu et al, issued Nov. 22, 1988, discloses a flexible photoreceptor containing certain specific blocking and adhesive layer materials. Generator layers containing a trigonal selenium photoconductive material and binders such as polycarbonate, polyvinylchloride, vinylchloride and vinylacetate copolymer, styrene butadiene copolymer and the like are disclosed.

U.S. Pat. No. 3,816,118 to Byrne, issued June 11, 1974, discloses an electrophotographic plate containing phthalocyanine pigment dispersed in a binder. Numerous binders are disclosed, including polyvinylchloride, polyvinylacetate, poly-styrene-polybutadiene copolymer, and phenoxy resins.

U.S. Pat. No. 4,340,658 to Inoue et al, issued July 20, 1982, discloses a laminated photosensitive material for electrophotography wherein, for example, zinc oxide is dispersed in a resin binder. Binders applicable for the photosensitive material include copolymers of vinylchloride/vinyl-acetate, polycarbonates, or styrene/-butadiene copolymers. The binders may be used singly or in the form of a mixture of two or more.

U.S. Pat. No. 4,701,396 to Hung et al, issued Oct. 20, 1987, discloses a photoconductive element containing dispersion coated flourine-substituted titanylphthalocyanine. Various binders such as styrene butadiene copolymer and polycarbonate are disclosed.

SUMMARY OF THE INVENTION

It is an object of the invention to provide an electrophotographic imaging member which overcomes the disadvantages of the prior art.

It is an object of the invention to provide a thin, flexible electrophotographic imaging member with improved resistance to delamination.

It is still another object of this invention to provide a thin, flexible electrophotographic imaging member having charge generating layers in which photoconductive particles are more uniformly dispersed in a binder and exhibit uniform electrical properties.

It is an object of the invention to provide a charge generating layer having a broad spectral response in the infrared and visible light spectrum.

It is also an object of the invention to provide a process for producing a charge generating layer having a homogeneous dispersion of trigonal selenium and phthalocyanine particles It is still another object of this invention to provide a thin, flexible electrophotographic imaging member containing charge generating layers which are readily coatable.

It is another object of this invention to provide a thin, flexible electrophotographic imaging member exhibiting improved adhesion between a charge generating layer and other layers.

The foregoing objects and others are accomplished in accordance with this invention by providing an electrophotographic imaging member comprising a supporting substrate having an electrically conductive surface, a charge generating layer and a charge transport layer, the charge generating layer comprising a homogeneous dispersion of photoconductive particles of trigonal selenium particles and phthalocyanine particles dispersed in a film forming binder. Styrene butadiene copolymers and mixtures thereof may be used as binders. This imaging member may be used in an electrophotographic imaging process.

BRIEF DESCRIPTION OF THE DRAWINGS

A more complete understanding of the present invention can be obtained by reference to the accompanying Figure which is a cross-sectional view of a multilayer photoreceptor of the invention.

DETAILED DESCRIPTION OF PREFERRED EMBODIMENTS

Figure 1:
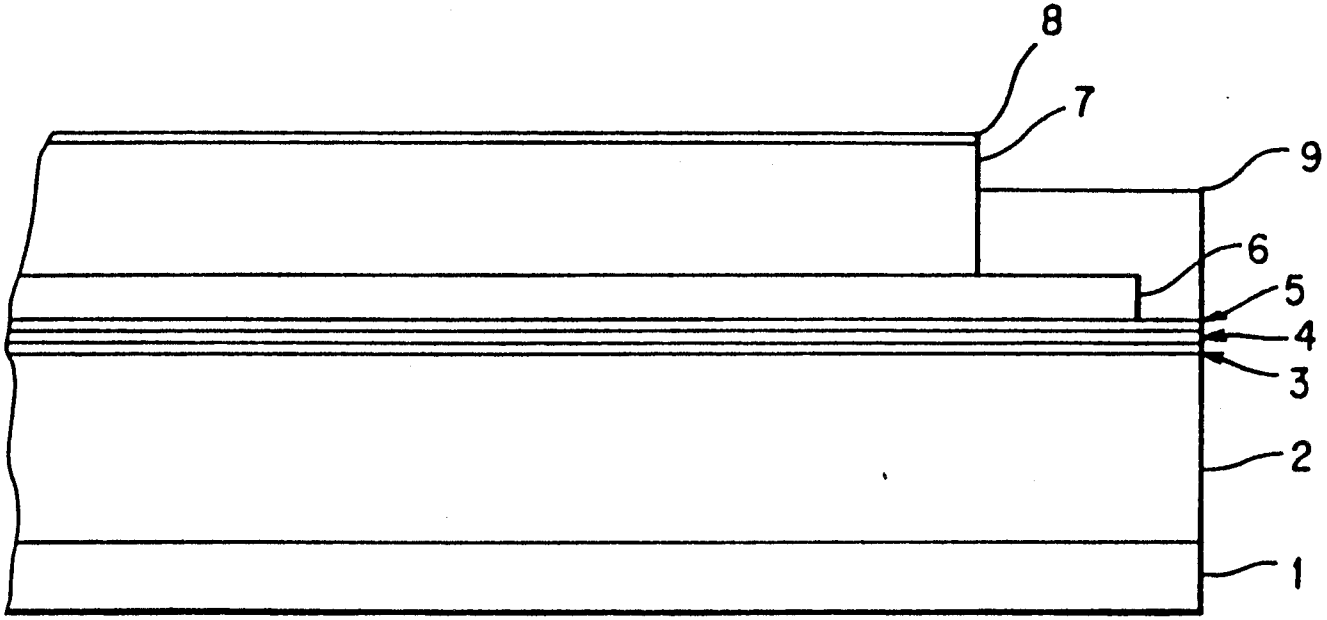

The electrophotographic imaging member according to the invention has a charge generating layer which includes trigonal selenium and phthalocyanine photoconductive particles homogeneously dispersed in a film forming binder. An electrophotographic imaging member of the invention may be provided with an anti-curl layer, a supporting substrate having an electrically conductive surface or ground plane, a hole blocking layer, an adhesive layer, a charge generating layer, and a charge transport layer. An optional overcoating layer may also be provided.

A representative structure of an electrophotographic imaging member is shown in the FIGURE. This imaging member is provided with an anti-curl back coating 1, a supporting substrate 2, an electrically conductive ground plane 3, a hole blocking layer 4, an adhesive layer 5, a charge generating layer 6, and a charge transport layer 7. Optional overcoating layer 8 and ground strip 9 are also shown in the FIGURE.

The supporting substrate layer having an electrically conductive surface may comprise any suitable flexible web or sheet material. The electrically conductive surface may be opaque or substantially transparent and may comprise any of numerous suitable materials having the required mechanical properties. For example, the substrate with an electrically conductive surface may comprise an underlying flexible insulating support layer coated with a flexible electrically conductive layer, or merely a flexible conductive layer having sufficient internal strength to support the electrophotoconductive layer and anticurl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. Accordingly, the conductive layer can generally range in thickness from about 50 Angstroms to many centimeters. When a highly flexible photoresponsive imaging device is desired, the thickness of the conductive layer may be between about 100 Angstroms to about 750 Angstroms. Any suitable underlying flexible support layer may be utilized such as a thermoplastic film forming polymer alone or a thermoplastic film forming polymer in combination with other materials such as conductive particles of metal, carbon black and the like. Typical underlying flexible support layers comprising film forming polymers include insulating non-conducting materials comprising various resins such as polyethersulfone resins, polycarbonate resins, polyvinyl fluoride resins, polystyrene resins and the like. Preferred substrates are polyethersulfone (Stabar S-100, available from ICI), polyvinyl fluoride (Tedlar, available from E.I. du Pont de Nemours & Company), biaxially oriented polyethylene terephthalate (Melinex, available from ICI), amorphous polyethylene terephthalate (Melinar, available from ICI Americas, Inc.) and the like. The coated or uncoated flexible supporting substrate layer is highly flexible and may have any number of different configurations such as, for example, a sheet, a scroll, an endless flexible belt, and the like.

If desired, any suitable charge blocking layer may be interposed between the conductive layer and the electrophotographic imaging layer. Some materials can form a layer which functions as both an adhesive layer and charge blocking layer. Typical blocking layers include polyvinylbutyral, organozilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. These silanes have the following structural formula:

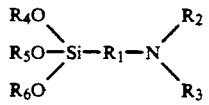

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$ and $R_6$ are independently selected from a lower alkyl group containing 1 to 4 carbon atoms. Typical hydrolyzable silanes include 3-aminopropyltriethoxysilane, N-aminotheyl-3-aminopropyltrimethoxysilane, N-2-aminoethyl-3-aminopropyltrimethoxysilane, N-2-aminoethyl-3-aminopropyltris(ethylethoxy) silane, p-aminophenyltrimethoxysilane, 3-aminopropyldiethylmethylsilane, (N,N'-dimethyl 3-amino)propyltriethoxysilane, 3-aminopropylmethyldiethoxysilane, 3-aminopropyltrimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers.

Any suitable technique may be utilized to apply the hydrolyzed silane solution to the metal oxide layer of a metallic conductive layer. Typical application techniques include spraying, dip coating, roll coating, wire wound rod coating, and the like. Generally, satisfactory results may be achieved when the reaction product of the hydrolyzed silane and metal oxide layer forms a layer having a thickness between about 20 Angstroms and about 2,000 Angstroms.

In some cases, optional intermediate layers between the locking layer and the adjacent charge generating or photogenerating material may be added. If such layers are utilized, they preferably have a dry thickness between about 0.01 micrometer to about 5 micrometers. Typical intermediate layers include film-forming polymers such as polyester, polyvinylbutyral, polyvinylpyrolidone, polyurethane, polymethyl methacrylate and the like.

Generally, the electrophotoconductive imaging member of the invention comprises a supporting substrate having an electrically conductive surface, an optional charge blocking layer, an optional intermediate layer, a charge generating layer and a charge transport layer, the charge generating layer comprising a homogeneous dispersion of photoconductive particles of trigonal selenium and phthalocyanine particles dispersed in a film forming polymer binder. Film forming binders which are suitable include, for example, styrene butadiene copolymers and mixtures thereof.

The mixtures of charge generating or photogenerating particles employed in the charge generating layer of this invention are mixtures of trigonal selenium particles and phthalocyanine particles. Generally, the trigonal selenium particles have an average particle diameter of between about 0.2 micrometer and about 1 micrometer. An average particle diameter of less than about 0.6 micrometer is preferred for greater coating uniformity and to optimize xerographic performance. Phthalocyanine particles of the invention have an average particle diameter between about 0.2 micrometer and about 1 micrometer. An average particle diameter less than about 0.6 micrometer is preferred.

In order to obtain trigonal selenium particles and phthalocyanine particles having the desired particle size, the particles should be milled separately. After milling the particles separately, the particles are then combined. Any suitable milling technique may be used to obtain the desired particle size. Milling techniques include, for example, use of a ball mill, attritor, or the like.

The film forming binder for the mixture of photoconductive particles in the charge generating layer of this invention preferably comprises styrene butadiene copolymers or mixtures thereof. The styrene butadiene copolymers of the present invention are soluble copolymers with about 85/15 to about 95/5 weight percent styrene to butadiene content, and have a glass transition temperature $T_g$ range of from about 50° C. to about 60° C. The weight-average molecular weight may range from about 50,000 to about 200,000 with a $M_w/M_n$ of between about 3 and about 8. $M_w/M_n$ is the ratio of the weight-average molecular weight $M_w$ to the number average molecular weight $M_n$.

Phthalocyanine particles which may be used in the invention include metal phthalocyanine particles as well as metal-free phthalocyanine particles. Preferably, the phthalocyanine particles are vanadyl phthalocyanine, copper phthalocyanine, titanyl phthalocyanine and/or metal-free phthalocyanines.

Generally, for dried generating layers of this invention, between about 5 percent by weight to about 80 percent by weight of the mixed photogenerating pigment is dispersed in between about 95 percent and about 20 percent by weight of binder. More preferably, between about 7 percent and about 30 percent by weight of the mixed photogenerating pigment is dispersed in between about 93 percent and about 70 percent by weight of the binder. The ratio of trigonal selenium particles to phthalocyanine particles may range from about 9:1 to about 1:9, and preferably is about 1:1. The specific proportions selected also depend to some extent on the thickness of the generating layer desired. The thickness of the photogenerating binder layer is not particularly critical. Generating layer thicknesses between about 0.1 micrometer to about 5 micrometers have been found to be satisfactory. The charge generating layer of the invention can have a light radiation sensitivity between about 450 nm and 900 nm.

The charge transport layer should also be capable of supporting the injection of photo-generated holes and electrons from the charge transport layer and allowing the transport of these holes or electrons through the charge transport layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is preferably transparent to radiation in a region in which the photoconductor is to be used. The active charge transport layer is a substantially non-photoconductive material which supports the injection of photogenerated holes from the generating layer. The active transport layer is normally transparent when exposure is effected through the active layer to ensure that most of the incident radiation is utilized by the underlying charge generating layer for efficient photogeneration. When used with a transparent substrate, imagewise exposure may be accomplished through the substrate with all light passing through the substrate. In this case, the charge transport material need not be transparent in the wavelength region of use. The charge transport layer in conjunction with the generating layer in the instant invention is a material which is an insulator to the extent that an electrostatic charge placed on the transport layer is not conducted in the absence of illumination at a rate sufficient to prevent the formation and retention of an electrostatic latent image thereon. The charge transport layer may comprise a hole transporting polymer or an activating compound dispersed in electrically inactive polymeric material.

Polymers having the capability of transporting holes contain repeating units of a polynuclear aromatic hydrocarbon which may also contain heteroatoms such as, for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)carbazole; polymethylene pyrene; poly-1-(pyrenyl)-butadiene; N-substituted polymeric acrylic acid amides of pyrene; the polymeric reaction product of N,N'-diphenyl N,N'bis (3-hydroxyphenyl)-[1,1'-biphenyl]-4,4' diamine and diethylene glycol bis-chloroformate, and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generating material and incapable of allowing the transport of these holes therethrough. This will convert the electrically inactive polymeric material to a material capable of supporting the injection of photogenerated holes from the generating material and capable of allowing the transport of these holes through the active layer in order to discharge the surface charge on the active layer.

Preferred electrically active layers comprise an electrically inactive resin material, e.g. a polycarbonate, polystyrene or polyether carbonate, made electrically active by the addition of one or more of the following compounds: poly-N-vinylcarbazole; poly-1-vinylpyrene; poly-9-vinylanthracene; polyacenaphthalene; poly-9-(4-pentenyl)-carbazole; poly-9-(5-hexyl)carbazole; polymethylene pyrene; poly-1-(pyrenyl-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl4,4'-diamine and the like.

An especially preferred transport layer employed in one of the two electrically operative layers in the multilayer photoconductor of this invention comprises from about 25 to about 75 percent by weight of at least one charge transporting aromatic amine compound and about 75 to about 25 percent by weight of a polymeric film forming resin in which the aromatic amine is soluble.

The charge transport layer forming mixture preferably comprises an aromatic amine compound of one or more compounds having the formula:

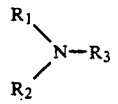

wherein $R_1$ and $R_2$ are each an aromatic group selected from the group consisting of a substituted or unsubstituted phenyl group, naphthyl group, and polyphenyl group, and $R_3$ is selected from the group consisting of a substituted or unsubstituted aryl group, alkyl group having from 1 to 18 carbon atoms and cycloaliphatic compounds having from 3 to 18 carbon atoms. The substituents should be free from electron withdrawing groups such as $NO_2$ groups, CN groups, and the like. Typical aromatic amine compounds that are represented by this structural formula include:

1. Triphenyl amines such as:

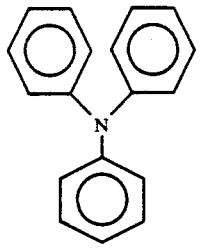

II. Bis and poly triarylamines such as:

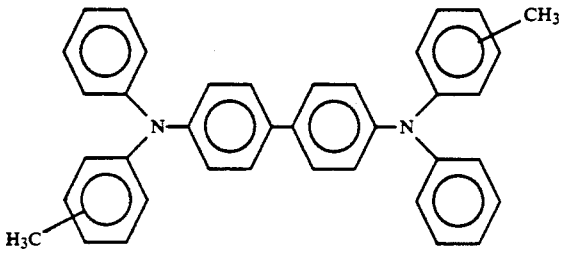

III. Bis arylamine ethers such as:

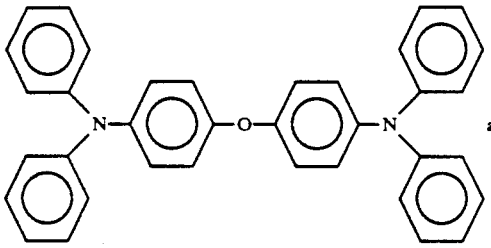

and

IV. Bis alkyl-arylamines such as:

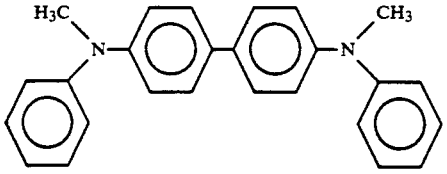

A preferred aromatic amine compound has the formula:

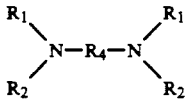

wherein $R_1$ and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms.

Excellent results in controlling dark decay and back ground voltage effects have been achieved when the imaging members comprising a charge generating layer comprise a layer of photoconductive material and a contiguous charge transport layer of a polycarbonate resin material having a molecular weight or from about 20,000 to about 120,000 having dispersed therein from about 25 to about 75 percent by weight of one or more diamine compounds having the formula:

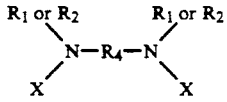

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes. The charge transport layer is substantially non-absorbing in the spectral region at which the photoconductive layer generates and injects photogenerated holes but is capable of supporting the injection of photogenerated holes from the photoconductive layer and transporting the holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis-diethylamino)-2', 2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, and the like dispersed in an inactive resin binder.

Any suitable inactive resin binder soluble in a suitable solvent may be employed with these aromatic amines. Typical inactive resin binders include polycarbonate resins such as poly(4,4'-isopropylidenediphenyl carbonate) and poly[1,1-cyclohexane-bis(4-phenyl)carbonate], polystyrene resins, polyether carbonate resins, 4,4'-cyclohexylidene diphenyl polycarbonate, polyarylate, and the like. Weight average molecular weights can vary from about 20,000 to about 1,500,000.

The preferred electrically inactive resin materials are polycarbonate resins having a weight average molecular weight from about 20,000 to about 100,000, more preferably from about 50,000 to about 100,000. The materials most preferred as the electrically inactive resin material are poly[1,1-cyclohexane-bis(4-phenyl)-carbonate]with a weight average molecular weight of from about 50,000 to about 100,000, poly(4,4'-dipropylidene-di-phenylene carbonate) with a weight average molecular weight from about 35,000 to about 40,000 (available as Lexan 145 from General Electric Company); poly(4,4'-isopropylidene-diphenylene carbonate) with a weight average molecular weight from about 40,000 to about 45,000 (available as Lexan 141 from the General Electric Company); a polycarbonate resin having a weight average molecular weight from about 50,000 to about 100,000 (available as Makrolon from Farbenfabricken Bayer A.G.) and a polycarbonate resin having a weight average molecular weight from about 20,000 to about 50,000 (available as Merlon from Mobay Chemical Company). Any suitable solvent such as methylene chloride may be used as a component of the charge transport layer coating mixture. The solvent preferably dissolves all of the coating composition components and has a low boiling point.

In all of the above charge transport layers, the activating compound which renders the electrically inactive polymeric material electrically active should be present in amounts from about 15 to about 75 percent by weight based on the total weight of the layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the transport layer is between bout 5 micrometers to about 100 micrometers, but thicknesses outside this range can also be used. The ratio of the thickness of the charge transport layer to the charge generating layer is preferably maintained from about 2:1 to 200:1 and in some instances as great as 400:1.

Although the location of the charge generating layer has been described above as between a charge transport layer and a conductive surface, the relative locations of the charge generating layer and charge transport layer may be reversed, if desired.

Optionally, a thin overcoat layer may also be utilized to improve resistance to abrasion. These overcoating layers may comprise organic polymers or inorganic polymers that are electrically insulating or slightly semi-conductive.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE

A photoconductive imaging member is prepared by providing a titanium coated polyester (Melinex, available from ICI Americas Inc.) substrate having a thickness of 3 mils, and applying thereto, using a Bird applicator, a solution containing 2.592 grams 3-aminopropyltriethoxysilane, 0.784 grams acetic acid, 180 grams of 190 proof denatured alcohol and 77.3 grams heptane. This layer is then dried for 5 minutes at room temperature and 10 minutes at 135° C. in a forced air oven. The resulting blocking layer has a dry thickness of 0.01 micrometer.

An adhesive interface layer is then prepared by applying a wet coating over the hole blocking layer, using a Bird applicator, containing 0.5 percent by weight based on the total weight of the solution of copolyester adhesive (DuPont 49,000, available from E.I. du Pont de Nemours & Co.) in a 70:30 volume ratio mixture of tetrahydrofuran/cyclohexanone. The adhesive interface layer is allowed to dry for one minute at room temperature and then dried for 10 minutes at 100° C. in a forced air oven. The resulting adhesive interface layer has a dry thickness of 0.05 micrometer.

In a two ounce bottle, 0.3 grams Pliolite, a styrenebutadiene diemethylamino ethylmethyl acrylate from Goodyear, 0.27 grams vanadyl phthalocyanine and 16 ml toluene/THF in a 50/50 ratio are added with 100 grams ½ inch steel shot and milled for 24 hours. If milling in methylene chloride, 440 grams of ½ inch stainless steel shot are used, with milling for about 36 hours. Ten grams of the mill base slurry are then added to 1.1 grams Pliolite and 17.4 grams toluene/THF solvent. This mixture is placed on a paint shaker for approximately 30 minutes.

In a four ounce bottle, 2.4 grams Pliolite, 2.4 grams trigonal selenium and 42.0 ml toluene/THF solvent in a 50/50 ratio are added with 300 gram ½ inch stainless steel shot. The mixture is milled for 3 days. A 6% solution of polymer is made by adding 2.4 grams Pliolite in 42 ml toluene/THF solvent. In a two ounce bottle, 15.2 grams of the trigonal selenium mill base is added to 16.4 grams of the 6% solution of Pliolite. This mixture is then placed on a paint shaker for about 20 minutes.

In a two ounce bottle, 10 grams of the trigonal-selenium dispersion and 10 grams of the vanadyl phthalocyanine dispersion are mixed and shaken on a paint shaker for at least 30 minutes. The resulting slurry is coated using a 0.0005 inch bar onto the adhesive interface layer. However, a strip about 3 mm wide along one edge of the substrate, blocking layer and adhesive layer is deliberately left uncoated by any of the photogenerating layer material to facilitate adequate electrical contact by the ground strip layer that is applied later. The wet layer is dried for 10 minutes at 90° C. and then for 5 minutes at 135° C. in a forced air oven.

This coated member is simultaneously overcoated with a charge transport layer. The charge transport layer is prepared by introducing into an amber glass bottle, in a weight ratio of 1:1, N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbenfabricken Bayer A.G. The resulting mixture is dissolved by adding methylene chloride. This solution is applied on the photogenerator layer to form a coating which upon drying has a thickness of 24 micrometers. The resulting photoreceptor device containing all of the above layers is annealed at 135° C. in a forced air oven for 6 minutes.

The multilayered photoreceptor exhibits substantially stable surface charging potentials from one xerographic cycle to the next cycle for 10,000 cycles. The multilayered photoreceptor spectral sensitivity decreased from about 58% discharge to about 0% discharge as the exposure wavelength increased from about 450 nm to about 925 nm for an exposure level of about 5 ergs/cm$^2$, and decreased from about 82% discharge to about 0% discharge as the exposure wavelength increased from about 450 nm to about 925 nm for an exposure level of about 10 ergs/cm$^2$. Dark decay for the multilayered photoreceptor is about 160 volts/second.

While the invention has been described with reference to particular preferred embodiments, the invention is not limited to the specific examples and embodiments described herein, and other embodiments and modifications can be made by those skilled in the art without departing from the spirit and scope of the invention.

What is claimed is:

1. An electrophotographic imaging member comprising a charge generating layer comprised of a homogeneous dispersion of a mixture of photoconductive particles of trigonal selenium and photoconductive particles of phthalocyanine dispersed in a styrene-butadiene copolymer.

2. The imaging member of claim 1, wherein said photoconductive particles have a particle size compatible in said styrene-butadiene copolymer.

3. The imaging member of claim 1, wherein said phthalocyanine particles are at least one of metal-free phthalocyanine, vanadyl phthalocyanine, copper phthalocyanine and titanyl phthalocyanine particles.

4. The imaging member of claim 1, wherein said trigonal selenium particles and said phthalocyanine particles are milled separately prior to being dispersed in said film forming polymer binder.

5. An electrophotographic imaging member comprising a charge generating layer comprised of a homogeneous dispersion of greater than about 5% by weight to about 80% by weight of a mixture of photoconductive particles of trigonal selenium and photoconductive particles of phthalocyanine dispersed in less than about 95% by weight to about 20% by weight of a film forming binder.

6. The imaging member of claim 1, wherein said styrene butadiene copolymer has a styrene to butadiene content of about 85:15 to about 95:5 and a glass transition temperature between about 50° C. and about 60° C.

7. The imaging member of claim 1, wherein said charge generating layer has a thickness of about 0.3 micrometer to about 5 micrometers.

8. The imaging member of claim 1, wherein said trigonal selenium particles have a particle diameter of about 0.2 micrometer to about 1 micrometer, and said phthalocyanine particles have a particle diameter of about 0.2 micrometer to about 1.0 micrometer.

9. The imaging member of claim 1, wherein said charge generating layer has a light radiation sensitivity between about 450 nm and about 900 nm.

10. An electrophotographic imaging member comprising a supporting substrate, a charge generating layer, and a charge transport layer, said charge generating layer comprising a homogeneous dispersion of a mixture of photoconductive particles of trigonal selenium and photoconductive particles of phthalocyanine dispersed in a styrene-butadiene copolymer.

11. The imaging member of claim 10, wherein said photoconductive particles are milled separately prior to dispersion.

12. The imaging member of claim 10, wherein said homogeneous dispersion contains greater than about 5% by weight to about 80% by weight of said mixture of photoconductive particles in less than about 95% by weight to about 20% by weight of said styrene-butadiene copolymer.

13. The imaging member of claim 10, wherein said styrene butadiene copolymer has a styrene to butadiene content of about 85:15 to about 95:5 and a glass transition temperature between about 50° C. and about 60° C.

14. The imaging member of claim 10, wherein said trigonal selenium is milled to a particle diameter of about 0.2 to about 1 micrometer and said phthalocyanine is milled to a particle diameter of about 0.2 to about 1 micrometer.

15. The imaging member of claim 10, wherein said charge generating layer has a thickness of about 0.3 micrometer to about 5 micrometers.

16. A process for making a charge generating layer, comprising the steps of:

separately milling trigonal selenium particles and phthalocyanine particles;

homogeneously dispersing said separately milled particles in a film forming polymer binder to form a dispersion;

and coating said dispersion to form a charge generating layer.

17. The process of claim 16, wherein said trigonal selenium particles are milled to a particle diameter of about 0.2 to about 1 micrometer, and said phthalocyanine particles are milled to a particle diameter of about 0.2 to about 1 micrometer.

18. The process of claim 16, wherein about 7 to about 30 weight percent of said trigonal selenium particles, and about 30 to about 7 weight percent of said phthalocyanine particles, are dispersed in said film forming polymer binder.

19. The process of claim 16, wherein said film forming polymer binder is a styrene butadiene copolymer having a styrene to butadiene ratio of about 85:15 to about 95:5.

20. The process of claim 16, wherein said charge generating layer is coated in a thickness of about 0.3 to about 5 micrometers.

* * * * *